United States Patent [19]

Fremlin

[11] 3,973,470

[45] Aug. 10, 1976

[54] HYDRAULIC INJECTION ENGINE

[75] Inventor: John E. Fremlin, Walled Lake, Mich.

[73] Assignees: Ronald H. Fremlin, Tahoe City; Robert E. Fremlin, Berkeley, both of Calif.

[22] Filed: July 25, 1975

[21] Appl. No.: 599,278

Related U.S. Application Data

[63] Continuation of Ser. No. 486,258, July 8, 1974, abandoned.

[52] U.S. Cl. ..... 91/413; 91/476; 92/146; 60/374; 60/484; 180/66 R

[51] Int. Cl.[2] ..... F15B 11/20

[58] Field of Search ..... 60/325, 327, 369, 374, 60/394, 407, 456, 471, 483, 484, 716, DIG. 2, DIG. 10; 91/413, 476, 499, 500, 265, 275; 92/146, 149; 180/65 R, 66 R, 44 F

[56] References Cited

UNITED STATES PATENTS

| | | | |
|---|---|---|---|
| 980,449 | 1/1911 | Sundh | 92/147 X |
| 1,099,472 | 6/1914 | Sundh | 60/484 |
| 1,251,849 | 1/1918 | Vernon | 60/410 |
| 2,138,237 | 11/1938 | Horton | 60/456 X |
| 3,090,362 | 5/1963 | Rolls | 91/275 X |
| 3,765,180 | 10/1973 | Brown | 60/374 X |

OTHER PUBLICATIONS

Washington Evening Star, Oct. 20, 1931.

Washington Herald, Oct. 22, 1931.

*Primary Examiner*—Edgar W. Geoghegan

*Attorney, Agent, or Firm*—Townsend and Townsend

[57] ABSTRACT

The present invention relates to an hydraulic motor adapted to be used in automobiles and other vehicles and which is derived from a standard reciprocating piston engine. Instead of igniting a fuel/air mixture, the present invention supplied hydraulic fluid under pressure to one or more cylinders of the engine to drive the pistons during their power stroke. The present invention also provides apparatus for releasing the pressure of the hydraulic fluid in the cylinders to allow the pistons to reciprocate.

5 Claims, 7 Drawing Figures

HYDRAULIC INJECTION ENGINE

This is a continuation of application Ser. No. 486,258, filed July 8, 1974, now abandoned.

BACKGROUND OF THE INVENTION

1. Field of the Invention

The present invention relates to power systems, and in particular to an hydraulic power system adapted to drive automobiles and other such vehicles.

2. Description of the Prior Art

The continued increase in the use of motorized transportation, particularly the passenger automobile, has given rise to two different but interrelated problems. First, there is the excessive consumption of available supplies of energy to power such vehicles, particularly fossil fuels which are rapidly becoming depleted and which cannot be replaced. Second, there is the air and noise pollution produced by such vehicles, and the harmful effects of this pollution on the environment. Many solutions have been proposed to resolve one or the other of these problems and some of these solutions are quite effective in achieving their objective. However, the defect common to virtually all of these solutions is that resolving one of the problems merely aggravates the other. As a result, one problem may be partially solved but the other problem is increased and no net benefit is achieved. This difficulty is becoming especially apparent as automobile manufacturers are attempting to meet pollution control requirements which have been imposed by the governments in many countries, and it appears that these requirements can only be met by substantially increasing the fuel consumption of the vehicle, solving one problem but aggravating the other. A secondary difficulty with meeting such pollution control requirements is that peripheral equipment must be added to the vehicle which both increases the cost of the vehicle and decreases its reliability as well as increasing its fuel consumption.

SUMMARY OF THE INVENTION

The present invention relates to an hydraulic motor adapted to be used in automobiles and other vehicles and which is derived from a standard reciprocating piston engine. Instead of igniting a fuel/air mixture, the present invention supplies hydraulic fluid under pressure to one or more cylinders of the engine to drive the pistons during their power stroke. The present invention also provides apparatus for releasing the pressure of the hydraulic fluid in the cylinders to allow the pistons to reciprocate and initiate a subsequent power stroke.

In the preferred embodiment of the present invention, a vehicle propulsion system is provided which includes a fossil fuel powered generator carried on the vehicle. An electric motor is driven by the generator and powers a hydraulic pump. The pump supplies hydraulic fluid from a reservoir to a standard reciprocating piston engine employing one or more pistons disposed within respective cylinders and connected to a common crank shaft. A foot control is provided to control the supply of hydraulic fluid from the pump to the cylinders of the engine so that such fluid is supplied to the cylinders to drive them in one direction to provide a power stroke. The pressure of the hydraulic fluid in the cylinders can be released either by the exhaust valves already forming part of the piston engine in one embodiment, or can alternatively be released by solenoid valves controlled by the distributor as in another embodiment.

The present invention is applicable both to new vehicle power systems, and also to retrofitting engines already in use in such vehicles. Existing reciprocating engines can be modified according to the teachings of the present invention to use hydraulic fluid as a source of power rather than the fuel/air mixture presently employed. In this mode, many of the standard engine components are removed from the engine and replaced with elements of the present invention. However, the basic engine block including its pistons, cylinders, and crank shaft is retained, and the existing exhaust port system and controlling cam shaft used to control the release of hydraulic fluid from the respective cylinders. If the teachings of the present invention are used to construct new power systems for vehicle use, solenoid valves are employed for releasing the hydraulic fluid from the cylinders rather than a cam shaft system to minimize the moving parts of the system.

The power system of the present invention has two fundamental advantages resulting primarily from the fact that the hydraulic system develops relatively large mechanical advantage, thus minimizing the input power required. The apparatus of the present invention is driven by a relatively small generator of three horsepower or more, and which thus requires extremely little fuel. Correspondingly, an engine of this size produces a very small volume of pollutants. Through the mechanical advantage obtained by the hydraulic system of the present invention, the power from this relatively small generator is more than sufficient to drive customary road vehicles.

The hydraulic power system of the present invention develops extremely high torque, even at relatively low engine speeds. As a result, wear of the engine parts is minimized to increase the useful life of the engine and the engine provides very little vibration to other components of the vehicle. The noise produced by the system is also relatively minor, and since the generator is quite small, it can easily be well muffled. Thus, the present invention provides a practical and efficient power system for road vehicles, one which appears to be far more reliable and effective than those currently being used.

The operation of the apparatus of the present invention is controlled primarily by a distributor which is connected to a plurality of solenoid operated valves, and eliminates the requirement for much of the equipment found on standard piston engines, such as carburetors, cam shafts, etc. Lubrication of the engine can be accomplished by the hydraulic fluid itself by using a lubricating fluid in the hydraulic system and allowing for a minor degree of controlled leakage of the fluid past the piston rings to lubricate the cylinders. An excess of electrical power will ordinarily be generated, and this power can be used to easily drive peripheral equipment on the vehicle, such as the heater, windshield wipers, air-conditioning, without materially increasing the fuel consumption of the vehicle. This allows for the continued use of systems providing a high degree of comfort for the passenger without increasing fuel consumption or resulting pollution.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
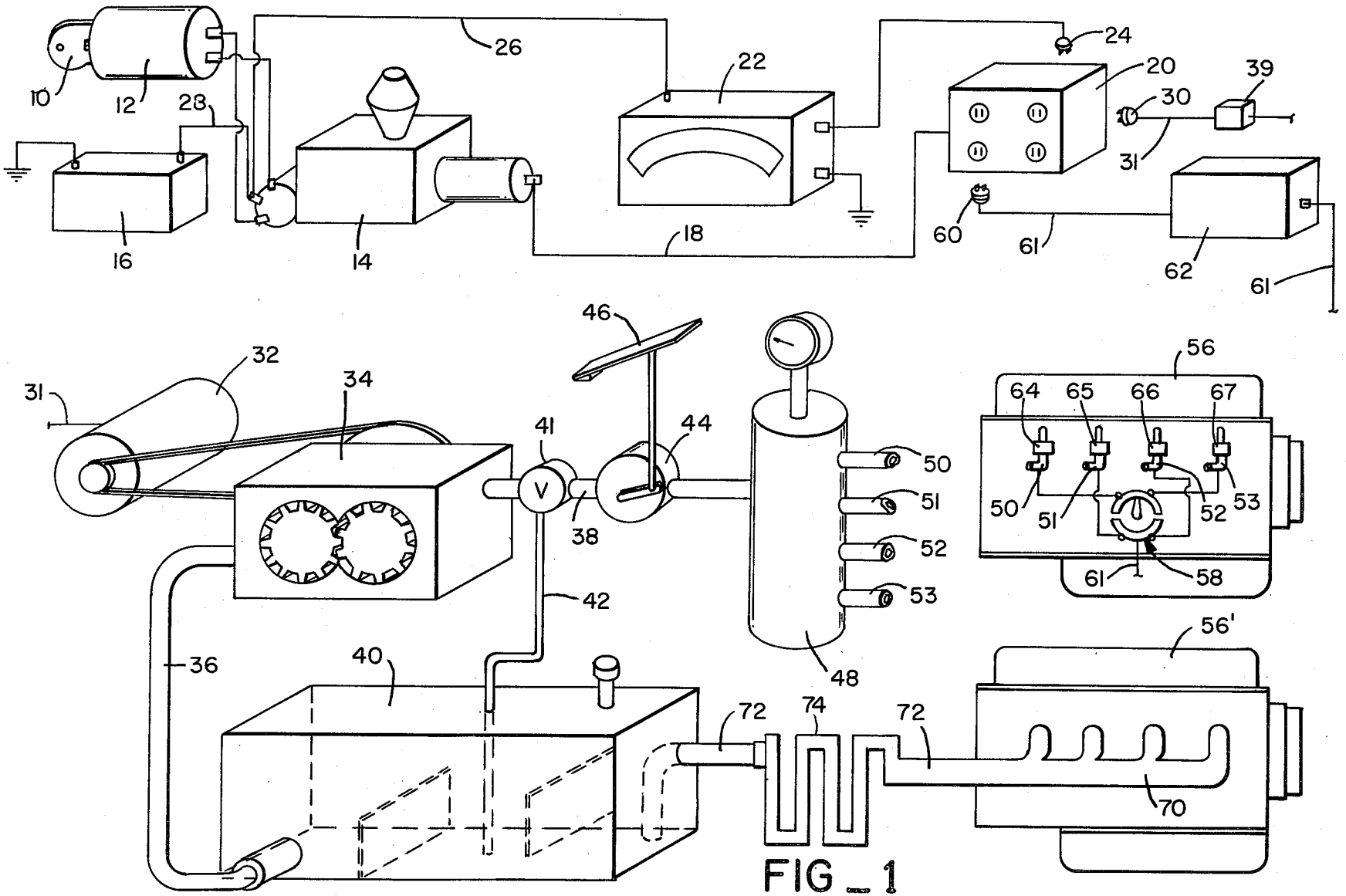
FIG. 1 is a schematic view of the system of the present invention.

The overall system of the present invention is illustrated by way of reference to the schematic view of FIG. 1. Operation of the system is initiated by key 10 which is inserted in ignition switch 12. Ignition switch 12 activates a starter on a generator or auxiliary gasoline unit 14 which runs on fossil fuel such as gaoline or propane. Generator 14 may be of the type which produces approximately 5500 watts continuous power with a surging wattage of 8,000 at about 110 volts. A 12½ hp motor weighing around 275 pounds and having exterior dimensions of 33 inches by 20 inches by 25 inches should be sufficient for the purposes of the present invention.

The output from generator 14 passes through lead 18 to plug-in unit 20. A 12-volt battery charger 22 has a plug 24 adapted to be fitted into plug-in unit 20 to connect the battery charger to the output of generator 14. Charger 22 is connected through leads 26, 28 to battery 16 to charge the battery. Battery 16 is used to start generator 14 and to provide reserve power when the generator is not in operation.

Another plug 30 is used to connect an electric motor 32 to the output of generator 14 through lead 31. Electric motor 32 having a power output in the range of ½ hp drives a gear pump 34 which is interposed in hydraulic lines 36, 38. If desired, electric motor 32 can be disconnected from generator 14 by on/off switch 39 for collateral use of the generator when the vehicle itself is not operating. A gear pump is preferred but any type of hydraulic pump could be used as well. Hydraulic fluid is drawn from reservoir 40 which contains about 5 gallons of such fluid, through hydraulic line 36 by pump 34 and forced into line 38 at the maximum pressure. Reservoir 40 has appropriate baffles and cooling elements as known in the hydraulic art. Excess pressure of the hydraulic fluid in line 38 is relieved by blow-off valve 41 connected to line 42 which returns excess fluid to reservoir 40. A pressure control valve 44 is interposed in hydraulic line 38 and is manipulated by foot pedal 46, thereby controlling the pressure of hydraulic fluid supplied to holding tank 48.

A plurality of hydraulic lines 50–53 emanate from holding tank 48 and lead to a standard piston engine 56. The downstream ends of hydraulic lines 50–53 are connected to the respective cylinders of engine 56, preferably through the spark plug hole, as will be further illustrated hereinafter. Distributor 58 is electrically connected to plug-in unit 20 by plug 60 through lead 61, with a voltage converter 62 interposed in the connection to operate the distributor at 12 volts. Distributor 58 is electrically connected to a plurality of solenoid operated valves 64–67 interposed in hydraulic lines 50–53 respectively. Individual solenoid operated valves 64–67 are periodically activated by distributor 58 to allow the flow of hydraulic fluid to the cylinders to drive the respective pistons during their power stroke.

After the power stroke of each respective cylinder has terminated, the pressure of the hydraulic fluid in the cylinder is released and the hydraulic fluid flows out through an exhaust manifold 70 at the other side 56' of engine 56. Such hydraulic fluid flows into a cooler 74 interposed in hydraulic line 72 back to reservoir 40 so that the hydraulic fluid can be continuously reused.

Figure 2:
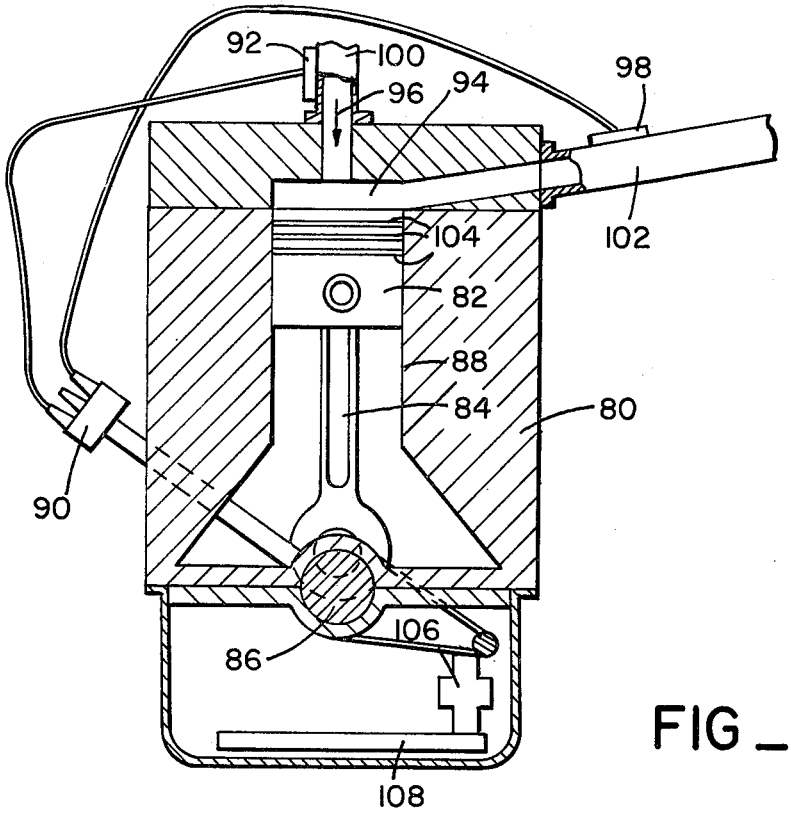
FIG. 2 is a front elevation view of the new power system constructed in accordance with the teachings of the present invention.

Engine 56 can be either an existing retrofitted piston engine or can be a new piston engine as illustrated at 80 in FIG. 2. The new engine 80 has a plurality of pistons 82, each having a depending connecting rod 84 connected to crank shaft 86. Piston 82 is disposed in cylinder 88 in which it reciprocates back and forth, the downward stroke being the power stroke and the upward stroke being the exhaust stroke. Distributor 90 is connected by means of a timing gear or other mechanism to crank shaft 86 so that the distributor operates in phase with the crank shaft.

Distributor 90 initially activates one solenoid valve 92 for injection of hydraulic fluid into the head portion 94 of cylinder 88, as illustrated by arrow 96. At this time, distributor 90 maintains discharge valve 98 in the closed position so that pressure is built up in cylinder head 94 by the incoming hydraulic fluid. Such fluid will force piston 82 downwardly to power crank shaft 86 so that power is derived from the engine. Since the diameter of the inlet tube 100 for the hydraulic fluid is much smaller than the diameter or bore of cylinder 88, a relatively large amount of force will be transmitted to crank shaft 86 relative to the force of the incoming hydraulic fluid. Thus, a relatively high mechanical advantage is obtained, allowing for the use of a relatively small auxiliary power unit 14 as discussed hereinabove.

After piston 82 has moved downwardly to its approximate bottom dead center position, distributor 90 closes injector valve 92 and opens discharge valve 98, allowing hydraulic fluid to flow out through line 102 into a cooler such as 74 illustrated previously and then back to reservoir 40 illustrated above.

If desired, the hydraulic fluid used to power piston 82 can be a lubricating oil. Such oil can be allowed to seep through piston rings 104 to lubricate the sides of cylinder walls 88. Such oil will collect in the oil pan and will be returned to reservoir 40 by a siphoning type system (not shown). An oil pump 106 lubricates the lower portion of the engine.

Figure 3:
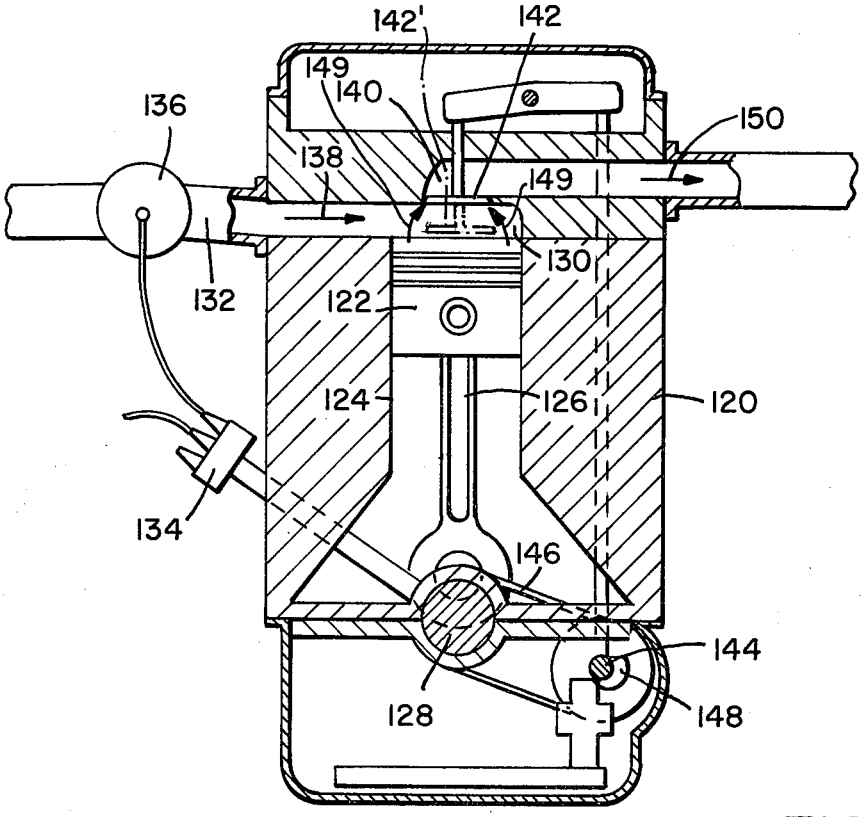
FIG. 3 is a front elevation view of an existing piston engine modified according to the teachings of the present invention.

The manner in which an existing piston engine 120 can be modified according to the teachings of the present invention to use hydraulic fluid as a source of power is illustrated by way of reference to FIG. 3. Engine 120 also utilizes several pistons such as 122 which reciprocate in cylinders such as 124, and which have depending connecting rods 126 connected to a crank shaft 128. The fuel/air inlet port (not shown) for cylinder head 130 is closed permanently, and an hydraulic line 132 is connected to cylinder head 130 in place of the spark plug.

Distributor 134 is connected to crank shaft 128 by means of a timing gear or other such mechanism on the cam shaft to synchronize operation of the distributor with that of the crank shaft. Distributor 134 sequentially operates solenoid valve 136 to allow hydraulic fluid to flow into cylinder head 130 as illustrated by arrow 138. At this time, exhaust port 140 will be closed by poppet valve 142 so that hydraulic pressure will build up in cylinder head 130 to force piston 122 downwardly to drive crank shaft 128. At the conclusion of the power stroke, distributor 134 will close solenoid valve 136. Cam shaft 144, connected to crank shaft 128 by means of belt 146, has a long dwell cam 148 adapted to open the poppet valve as illustrated at 142' during the exhaust cycle of piston 122 when it moves from bottom dead center to top dead center. Thus, hydraulic fluid will flow out of cylinder head 130 as illustrated by arrows 149, 150 to allow piston 122 to return to top dead center so that it can initiate a second power stroke.

It is apparent from FIG. 3 that refitting standard piston engine 120 according to the teachings of the present invention will substantially reduce the peripheral equipment attendant thereto. The need for a large carburetor system, one of the most complex mechanisms in current automobile engines, is eliminated, along with spark plugs, etc. In their place a simple distributor system which operates a plurality of solenoid valves is substituted and an auxiliary power unit and electric motor are added. Hence, many standard automobile engines can be conveniently and quickly converted into operation according to the teachings of the present invention to achieve both fuel economy and low pollution.

Figure 4:
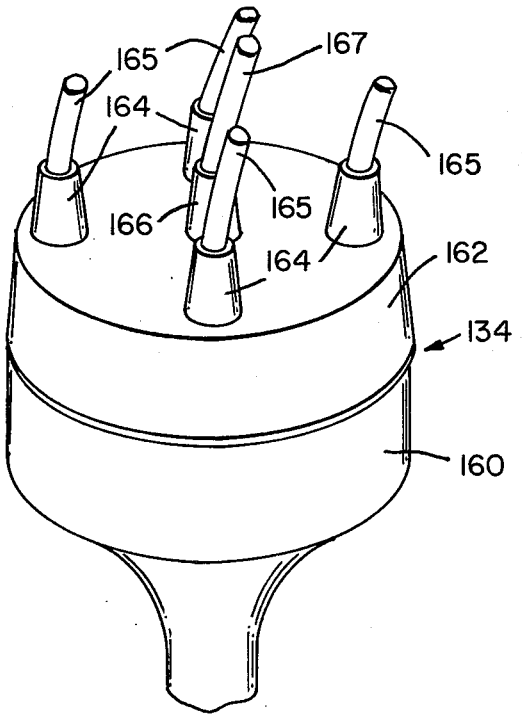
FIG. 4 illustrates a distributor used for retrofitting existing piston engines.
Figure 5:
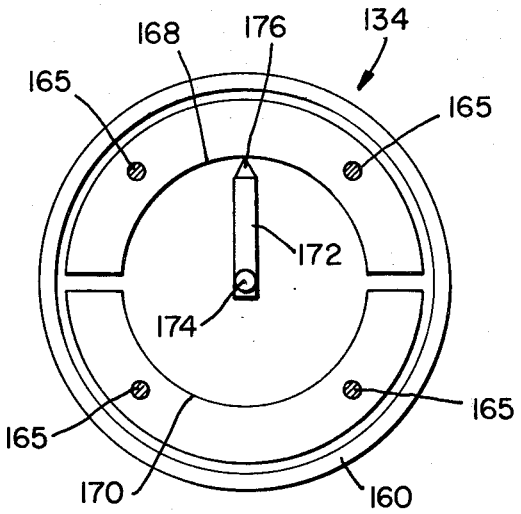
FIG. 5 is a cross-sectional plan view of the distributor used to modify existing piston engines.

Distributor 134 used in retrofitting an existing piston engine is illustrated in more detail by way of reference to FIGS. 4 and 5. Distributor 134 has an electrically insulative casing 160, and a rubberized cover 162 which fits over the casing. A plurality of electrical connections to the distributor can be made by inserting wires 165 through apertures 164 and disposed around the periphery of cover 162. Wires 165 extending through apertures 164 pass to each of the respective solenoid valves for the various cylinders of the engine. Due to the extreme torque developed by the pistons of the engine when they are operated with hydraulic fluid, it is anticipated that only four cylinders of the engine need be used even though the engine may be provided with six or eight such cylinders. A central aperture 166 is located in cap 162 so that the distributor can be electrically connected to the generator by wire 167 as illustrated previously.

A pair of opposed generally semicircular contact surfaces 168, 170 are located inside casing 160. A rotor 172 is disposed inside casing 160 and is adapted to rotate about an axis 174 which is common to surfaces 168, 170. The tip 176 of rotor 172 is adapted to serially contact contact surfaces 168, 170 as it rotates. Tip 176 is electrically conductive and connected to the generator by wire 167 so that it successively energizes first contact surface 168 and then contact surface 170 during each complete revolution of the rotor. Contact surfaces 168, 170 are electrically connected to wires 165 to successively energize the associated solenoid valves in turn. It is apparent that two of the cylinders will be on one cycle, such as the power cycle, while the other two cylinders will be on the opposite cycle, such as the exhaust cycle. If the engine to be retro-fitted does not have paids of cylinders on the exact same cycle, it is evident that the distributor arrangement shown in FIGS. 4 and 5 must be modified to some degree, such as providing various layers of contact surfaces to control the cylinders on their various cycles.

Contact surfaces 168, 170 are preferably nearly semicircular and traverse an arc of slightly less than 180° in order that hydraulic fluid is injected into the cylinders during virtually their entire downstroke or power stroke to provide constant power to the crank shaft. Since the piston is moving at virtually zero velocity at both top and bottom dead centers, it is desirable to delay injecting hydraulic fluid into the cylinder until slightly after top dead center, and terminate the flow of hydraulic fluid slightly before bottom dead center to promote smooth running of the engine and minimize internal stresses.

Figure 6:
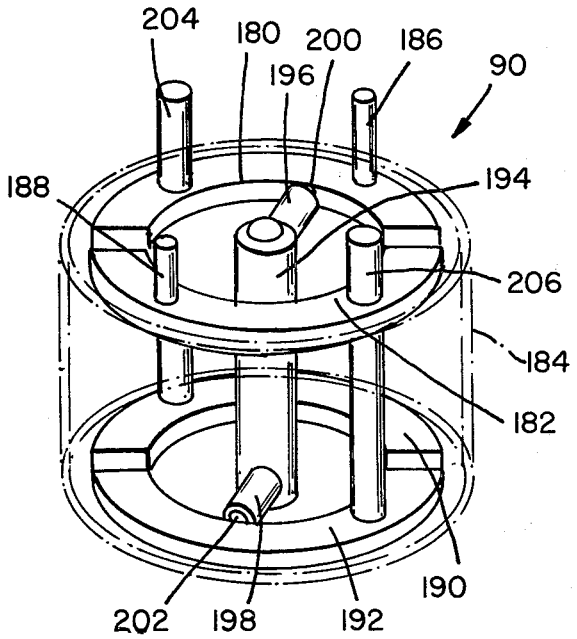
FIG. 6 is a perspective view of a distributor used for new power systems with the casing of the distributor broken away.
Figure 7:
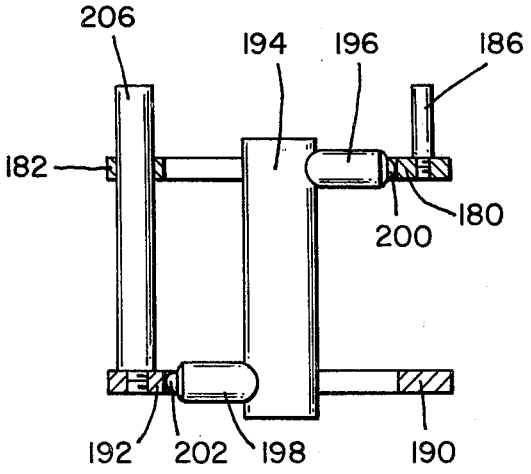
FIG. 7 is an elevation view of the rotor assembly of the distributor of FIG. 6.

The interior configuration of distributor 90 used in new power systems embodying the teachings of the present invention is illustrated in FIGS. 6 and 7. Distributor 90 includes an upper set of injector contact surfaces 180, 182 disposed within casing 184. Contact surfaces 180, 182 are generally similar to the contact surfaces 168, 170 illustrated in FIG. 5. A pair of electrical connectors 186, 188 are connected to the respective contact surfaces 180, 182 and are in turn connected to wires leading to solenoid valves controlling the injection of hydraulic fluid to the respective cylinders.

A second lower set of generally semicircular contact surfaces 190, 192 are disposed below contact surfaces 180, 182 and are used for controlling the discharge of hydraulic fluid from the respective cylinders of the engine during their exhaust stroke. Contact surfaces 190, 192 may traverse an arc of slightly greater than 180° and may overlap slightly at their ends so that the discharge of hydraulic fluid from the respective cylinders can take place slightly after top dead center and slightly before bottom dead center to facilitate smooth running of the engine.

A rotor 194 rotatable about the common axis of the respective contact surfaces 180, 182 and 190, 192 is provided in distributor 90. Rotor 194 has two oppositely directed projections 196, 198 each having an electrically conducted tip 200, 202 respectively. Tip 200 is in intermittent contact with injector contact surfaces 180, 182 whereas tip 202 is in intermittent contact with discharge contact surfaces 190, 192. Rotor 194 and tips 200, 202 thereof are electrically connected to the generator so that the respective injector and discharge contact surfaces are serially activated. Activation of contact surface 180 will actuate the injector solenoid valves electrically connected to connector 186, and subsequent activation of contact surface 182 will actuate the injector solenoid valves electrically connected with connector 188.

A pair of posts 204, 206 are connected to contact surfaces 190, 192 respectively. Each post 204, 206 has an electrically conductive core surrounded by insulation. Posts 204, 206 project upwardly through corresponding apertures in injector contact surfaces 180, 182 to which they are not electrically connected, to provide access to the discharge contact surfaces. Posts 204, 206 are connected to wires (not shown) leading to the discharge solenoid valves of the engine to control the operation thereof. Since the projections 196, 198 are disposed 180° apart, certain of the cylinders in the engine will have their associated solenoid valves electrically connected to connector 186 and post 204, while other cylinders will have their solenoid valves electrically connected to connector 188 and post 206. As discussed in regard to the previous embodiment, distributor configuration 90 requires that the cylinders of the engine used for the purpose of the present invention operate on diametrically opposed cycles.

The operation of the present invention proceeds as follows. Actuation of ignition switch 12 by key 10 starts a generator 14, using energy stored in battery 16. After generator 14 is started, it will recharge the battery for future starting power. Generator 14 also supplies electric power to electric motor 32 to operate hydraulic pump 34 which pressurizes line 38 with hydraulic fluid. Output of pump 34 is controlled by foot pedal 46 by the operator of the vehicle.

The hydraulic pressure in line 38 is divided into a plurality of secondary lines 50–53 by holding tank 48. The flow of such hydraulic fluid to the cylinder heads of the engine is controlled by solenoid valves 64–67. These solenoid valves are serially actuated in pairs by distributor 58 (see specific embodiments 90 and 134) to power the pistons in the engine during their respective power strokes. Discharge of hydraulic fluid from these cylinders during their exhaust strokes is controlled either by additional solenoid valves or by the exhaust valves already contained in the engine. In this matter, a standard reciprocating piston engine is completely powered by hydraulic fluid to operate as an hydraulic motor and obtains all the advantages associated therewith, all power being derived from a relatively small auxiliary power unit 14.

While the preferred embodiments of the present invention have been illustrated in detail, it is apparent that modifications and adaptations of those embodiments will occur to those skilled in the art. For example, various different embodiments of the distributor mechanism could be designed within the framework of the present invention. However, it is to be expressly understood that such modifications and adaptations are within the spirit and scope of the present invention, as set forth in the following claims.

What I claim as new is:

1. A distributor system adapted to be retrofitted to a standard reciprocating piston engine having one or more sets of pistons on opposing cycles to convert the engine into an hydraulic motor, said distributor comprising:

an even number of solenoid valves, each said valve corresponding to a respective cylinder of the piston engine to control the flow of hydraulic fluid to said cylinders;

first and second nearly semicircular juxtaposed contact surfaces having a common axis, one contact surface electrically connected to the solenoid valves associated with one piston of each set and the other contact surface electrically connected to the solenoid valves associated with the other piston of each set; and a rotor radially mounted interior of the contact surfaces and rotatable about the common axis of the contact surfaces, the tip of said rotor being electrically conductive and adapted to contact the respective contact surfaces in turn to provide intermittent electrical connections therebetween, said rotor tip being connected to an electrical power source to serially activate first solenoid valves associated with one piston of each set and then the solenoid valves associated with the other piston of each set to operate the piston engine with hydraulic fluid.

2. A distributor system as recited in claim 1 wherein the piston engine includes a poppet valve associated with each cylinder, and a cam shaft mechanically connected to the crank shaft of the engine and adapted to actuate the poppet valve responsive to movement of said crank shaft to permit exhaust of the hydraulic fluid from the cylinder.

3. A distributor system for an hydraulic piston motor having one or more sets of reciprocating pistons inside associated cylinders, the pistons of each set being on opposite cycles, said distributor system comprising:

an even number of electrically actuated injector valves, each said injector valve corresponding to a respective cylinder of the piston motor to control the flow of hydraulic fluid to said cylinders;

an even number of electrically actuated discharge valves, each said discharge valve corresponding to a respective cylinder of the piston motor to control the discharge of hydraulic fluid from said cylinders;

a pair of injector contact surfaces, said surfaces comprising first and second generally semicircular juxtaposed electrically conductive surfaces having a common axis, one contact surface electrically connected to the injector valves associated with one piston of each set and the other contact surface electrically connected to the injector valves associated with the other piston of each set;

a set of discharge contact surfaces, said discharge contact surfaces comprising first and second generally semicircular juxtaposed electrically conductive surfaces having a common axis coincident with the axis of the injector contact surfaces, one discharge contact surface electrically connected to the discharge valves associated with one piston of each set and the other discharge contact surface connected to the discharge valves associated with the other piston of each set; and a rotor mounted interior of the contact surfaces and rotatable about the common axis of the contact surfaces, said rotor having a pair of electrically conductive tips, one such tip adapted to contact the respective injector contact surfaces in turn to provide intermittent electrical connections therebetween, the other such tip adapted to contact the respective discharge contact surfaces in turn to provide intermittent electrical connections therebetween, said rotor tips being connected to an electrical power source to successively activate the valves to operate the motor.

4. A distributor system as recited in claim 1 wherein the electrically conductive tips of the rotor are disposed 180° apart.

5. A distributor system as recited in claim 3 wherein the injector contact surfaces are disposed relatively above the discharge contact surfaces, and additionally comprising insulated posts projecting downwardly through the injector contact surfaces to the discharge contact surfaces to electrically connect said discharge contact surfaces to the discharge valves.

* * * * *